US010978005B2

(12) United States Patent
Lee

(10) Patent No.: US 10,978,005 B2
(45) Date of Patent: Apr. 13, 2021

(54) DISPLAY DEVICE AND METHOD OF DRIVING THE SAME

(71) Applicant: SAMSUNG DISPLAY CO., LTD., Yongin-si (KR)

(72) Inventor: Seung Woo Lee, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/514,262

(22) Filed: Jul. 17, 2019

(65) Prior Publication Data

US 2020/0035167 A1 Jan. 30, 2020

(30) Foreign Application Priority Data

Jul. 27, 2018 (KR) ..... 10-2018-0087715

(51) Int. Cl.
*G09G 3/3275* (2016.01)

(52) U.S. Cl.
CPC ..... *G09G 3/3275* (2013.01); *G09G 2310/027* (2013.01); *G09G 2310/08* (2013.01)

(58) Field of Classification Search
CPC ..... G09G 3/3275
See application file for complete search history.

(56) References Cited

U.S. PATENT DOCUMENTS 8,823,721 B2 9/2014 Vasquez et al.
10,056,024 B2 8/2018 Kim et al.
2013/0135282 A1* 5/2013 Jeon ..... G09G 3/3696 345/212
2014/0307168 A1* 10/2014 Law ..... G09G 5/12 348/500
2016/0239249 A1* 8/2016 Lee ..... G09G 5/12
2017/0182416 A1 6/2017 Lee et al.

FOREIGN PATENT DOCUMENTS

KR 101229590 B1 1/2013
KR 1020160129934 A 11/2016
KR 1020170076478 A 7/2017

* cited by examiner

*Primary Examiner* — William Boddie
*Assistant Examiner* — Jeffrey Parker
(74) *Attorney, Agent, or Firm* — Cantor Colburn LLP

(57) ABSTRACT

A display device includes a display unit which includes pixels and displays an image, a data driver which supplies a data signal to the pixels, and a timing controller which controls the data driver using a timing control signal. Here, the timing control signal may include a vertical synchronization signal for defining a frame period and a data enable signal for defining a display period during which an image is displayed and a blank period during which an image is not displayed. Here, lengths of blank periods may be equal to each other in a first driving mode in which the vertical synchronization signal is supplied to the timing controller in a constant cycle and in a second driving mode in which the vertical synchronization signal is supplied in different cycles.

13 Claims, 5 Drawing Sheets

| FRn-1 | | | FRn | | | FRn+1 | | |
|---|---|---|---|---|---|---|---|---|
| FPP | DPP | BPP | FPP | DPP | BPP | FPP | DPP | BPP |
| 200 | 2000 | 16 | 200 | 2000 | 16 | 200 | 2000 | 16 |
| 2216 | | | 2216 | | | 2216 | | |

| FRn-1 | | | FRn | | | FRn+1 | | |
|---|---|---|---|---|---|---|---|---|
| FPP | DPP | BPP | FPP | DPP | BPP | FPP | DPP | BPP |
| 200 | 2000 | 16 | 200 | 2000 | 128 | 200 | 2000 | 58 |
| 2216 | | | 2328 | | | 2258 | | |

FIG. 8

| FRn-1 | | | FRn | | | FRn+1 | | | FRn+2 | | |
|---|---|---|---|---|---|---|---|---|---|---|---|
| FPP | DPP | BPP | FPP | DPP | BPP | FPP | DPP | BPP | FPP | DPP | BPP |
| 200 | 2000 | 16 | 200 | 2000 | 128 | 88 | 2000 | 58 | 158 | 2000 | 16 |
| | | | | | 2216 | | | 2216 | | | |

DISPLAY DEVICE AND METHOD OF DRIVING THE SAME

The application claims priority to Korean patent application No. 10-2018-0087715 filed on Jul. 27, 2018, and all the benefits accruing therefrom under 35 U.S.C. § 119, the content of which in its entirety is herein incorporated by reference.

BACKGROUND

1. Field

Various embodiments of the invention relate to a display device and a method of driving the display device.

2. Description of the Related Art

With a development of information technology, an importance of a display device that is a connection medium between a user and information has been emphasized. In accordance with this trend, a use of the display device such as a liquid crystal display device or an organic light-emitting display device has increased.

Recently, for precise image processing, a method of driving a display device while changing a period of one frame has been used. Therefore, a method that is capable of improving display quality when the frame period of an image displayed on the display device changes is desired.

SUMMARY

Various embodiments of the invention are directed to a display device that is capable of improving display quality.

An exemplary embodiment of the invention may provide a display device. The display device may include a display unit which includes a plurality of pixels and displays an image, a data driver which supplies a data signal to the plurality of pixels, and a timing controller which controls the data driver using a timing control signal that is externally inputted, wherein the timing control signal includes a vertical synchronization signal for defining a frame period and a data enable signal for defining a display period during which the image is displayed on the display unit and a blank period during which the image is not displayed on the display unit, and wherein lengths of blank periods are equal to each other in a first driving mode in which the vertical synchronization signal is supplied to the timing controller in a constant cycle and in a second driving mode in which the vertical synchronization signal is supplied to the timing controller in cycles different from the constant cycle.

In an exemplary embodiment, the blank period may include a first porch period between a time point at which the frame period starts and a time point at which the display period starts; and a second porch period between a time point at which the display period ends and a time point at which the frame period ends.

In an exemplary embodiment, a cycle of the vertical synchronization signal may be changed as a length of the second porch period is changed.

In an exemplary embodiment, in the second driving mode, when a length of a second porch period included in an n-th frame period, where n is a natural number equal to or greater than 2, is increased above a length of a second porch period included in an n−1-th frame period, a length of a first porch period included in an n+1-th frame period is decreased below a length of a first porch period included in the n-th frame period.

In an exemplary embodiment, an increased length of the second porch period may be equal to a decreased length of the first porch period.

In an exemplary embodiment, in the second driving mode, when a length of a second porch period included in an n-th frame period, where n is a natural number equal to or greater than 2, is decreased below a length of a second porch period included in an n−1-th frame period, a length of a first porch period included in an n+1-th frame period is increased above a length of a first porch period included in the n-th frame period.

In an exemplary embodiment, a decreased length of the second porch period may be equal to an increased length of the first porch period.

In an exemplary embodiment, lengths of display periods may be equal to each other in the first driving mode and the second driving mode.

In an exemplary embodiment, the data driver may supply the data signal to the plurality of pixels while the data enable signal is being supplied.

In an exemplary embodiment, in the first driving mode, lengths of first porch periods included in respective frame periods are equal to each other and lengths of second porch periods included in the respective frame periods are equal to each other.

An exemplary embodiment of the invention may provide a method of driving a display device. The method may include receiving, by a timing controller, a timing control signal that is externally inputted, controlling, by the timing controller, a data driver in response to the timing control signal, and supplying, by the data driver, a data signal to a plurality of pixels included in a display unit, wherein the timing control signal includes a vertical synchronization signal for defining a frame period and a data enable signal for defining a display period during which an image is displayed on the display unit and a blank period during which the image is not displayed on the display unit, and wherein lengths of blank periods are equal to each other in a first driving mode in which the vertical synchronization signal is supplied to the timing controller in a constant cycle and in a second driving mode in which the vertical synchronization signal is supplied to the timing controller in cycles different from the constant cycle.

In an exemplary embodiment, the blank period may include a first porch period between a time point at which the frame period starts and a time point at which the display period starts, and a second porch period between a time point at which the display period ends and a time point at which the frame period ends.

In an exemplary embodiment, in the second driving mode, when a length of a second porch period included in an n-th frame period, where n is a natural number equal to or greater than 2, is increased above a length of a second porch period included in an n−1-th frame period, a length of a first porch period included in an n+1-th frame period is decreased below a length of a first porch period included in the n-th frame period.

In an exemplary embodiment, an increased length of the second porch period may be equal to a decreased length of the first porch period.

In an exemplary embodiment, the lengths of display periods may be equal to each other in the first driving mode and the second driving mode.

BRIEF DESCRIPTION OF THE DRAWINGS

The above and other exemplary embodiments, advantages and features of this disclosure will become more apparent by describing in further detail exemplary embodiments thereof with reference to the accompanying drawings, in which:

FIG. 8 is a diagram illustrating an example in which the lengths of a front porch period, a display period, and a back porch period illustrated in FIG. 7 are exemplarily represented by numerical values.

DETAILED DESCRIPTION

Figure 1:
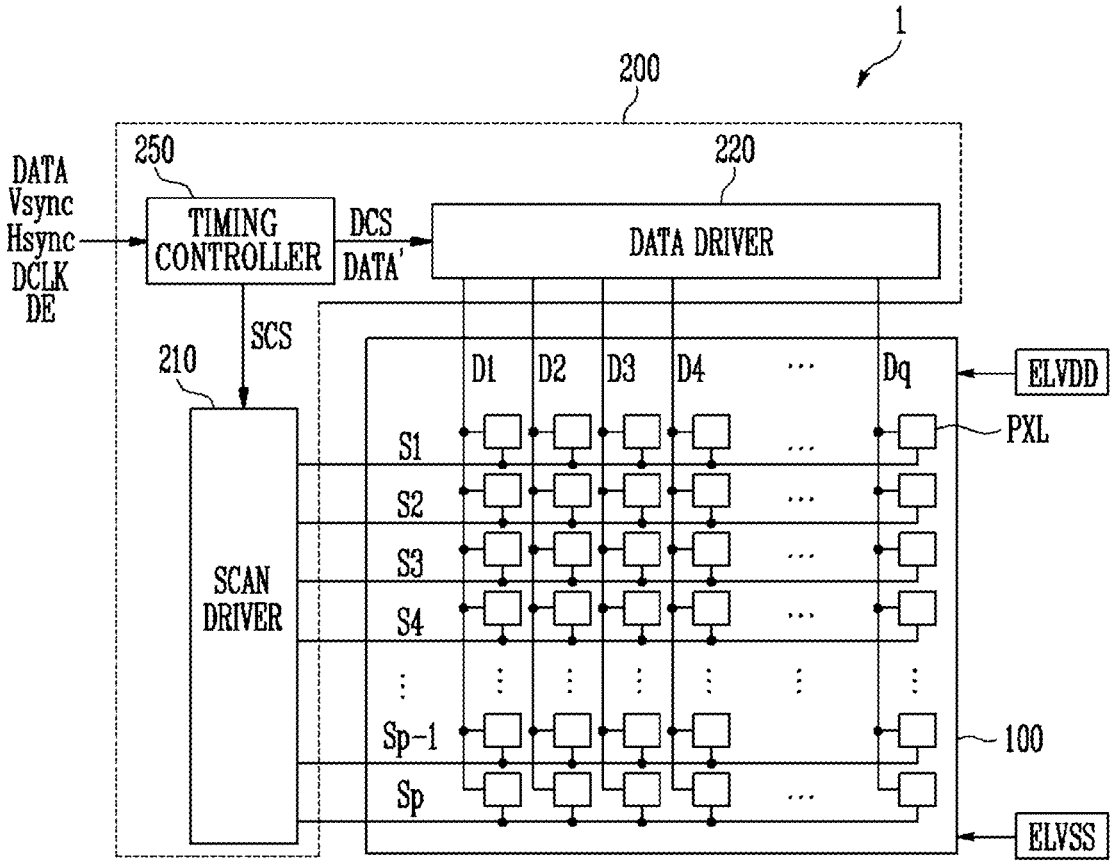
FIG. 1 is a block diagram schematically illustrating an exemplary embodiment of the configuration of a display device according to the invention.

Details of various embodiments are included in the detailed descriptions and drawings.

Advantages and features of the disclosure, and methods for achieving the same will be cleared with reference to embodiments described later in detail together with the accompanying drawings. However, it is to be noted that the disclosure is not limited to the exemplary embodiments but can be embodied in various other ways. In this specification, "connected/coupled" refers to one component not only directly coupling another component but also indirectly coupling another component through an intermediate component. Furthermore, in drawings, portions unrelated to the disclosure have been omitted to clarify the description of the disclosure, and the same reference numerals are used throughout the different drawings to designate the same or similar components.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, a display device and a method of driving the display device according to embodiments of the invention will be described with reference to the attached drawings pertaining to the exemplary embodiments of the invention.

FIG. 1 is a block diagram schematically illustrating the configuration of a display device according to an exemplary embodiment of the invention.

Referring to FIG. 1, a display device 1 according to an exemplary embodiment of the invention may include a display unit 100 and a display driving unit 200.

The display unit 100 may include pixels PXL, and data lines D1 to Dq and scan lines S1 to Sp which are coupled to the pixels PXL where p and q are natural numbers.

The respective pixels PXL may be supplied with data signals through the corresponding data lines D1 to Dq and supplied with scan signals through the corresponding scan lines S1 to Sp.

The pixels PXL may be coupled to a first power source ELVDD and a second power source ELVSS.

Each pixel PXL may include a light-emitting element (e.g., an organic light-emitting diode), and may generate light corresponding to a data signal by current flowing from the first power source ELVDD to the second power source ELVSS via the light-emitting element. In an exemplary embodiment, the first power source ELVDD may correspond to a high potential voltage, and the second power source ELVSS may correspond to a low potential voltage, for example.

The display driving unit 200 may include a scan driver 210, a data driver 220, and a timing controller 250.

The scan driver 210 may supply scan signals to the scan lines S1 to Sp in response to a scan driver control signal SCS. In an exemplary embodiment, the scan driver 210 may sequentially supply the scan signals to the scan lines S1 to Sp, for example.

For coupling to the scan lines S1 to Sp, the scan driver 210 may be directly disposed (e.g., mounted) on a substrate provided with the pixels PXL, or may be coupled to the substrate through a separate component such as a flexible circuit board.

The data driver 220 may receive a data driver control signal DCS and image data DATA' from the timing controller 250, and may then generate data signals.

The data driver 220 may supply the generated data signals to the data lines D1 to Dq.

For coupling to the data lines D1 to Dq, the data driver 220 may be directly disposed (e.g., mounted) on the substrate provided with the pixels PXL, or may be coupled to the substrate through a separate component such as a flexible circuit board.

If a scan signal is supplied to a predetermined scan line, some pixels PXL coupled to the predetermined scan line may receive data signals transferred from the corresponding data lines D1 to Dq. Thus, those pixels PXL may emit light with luminance corresponding to the received data signals.

The timing controller 250 may generate control signals for controlling the scan driver 210 and the data driver 220.

In an exemplary embodiment, the control signals may include the scan driver control signal SCS for controlling the scan driver 210, and the data driver control signal DCS for controlling the data driver 220, for example.

The timing controller 250 may generate the scan driver control signal SCS and the data driver control signal DCS using an external input signal.

In an exemplary embodiment, the external input signal (also referred to as a timing control signal) may include a dot clock DCLK, a data enable signal DE, a vertical synchronization signal Vsync, and a horizontal synchronization signal Hsync, for example.

Also, the timing controller 250 may provide the scan driver control signal SCS to the scan driver 210 and provide the data driver control signal DCS to the data driver 220.

In an exemplary embodiment, the timing controller 250 may convert an external image data DATA that is externally inputted into image data DATA' meeting the specifications of the data driver 220, and may then supply the converted image data DATA' to the data driver 220, for example. However, the invention it's not limited thereto, and the image data DATA' output from the timing controller 250 may be the same as the external image data DATA input to the timing controller 250.

The image data DATA may include luminance information of each of the pixels PXL of the display unit 100, and may be divided into frames.

The data enable signal DE may be a signal defining a period during which valid data is inputted.

Although the scan driver 210, the data driver 220, and the timing controller 250 are illustrated as being separately provided in FIG. 1, at least some of the foregoing components may be integrated with each other when needed.

Figure 2:
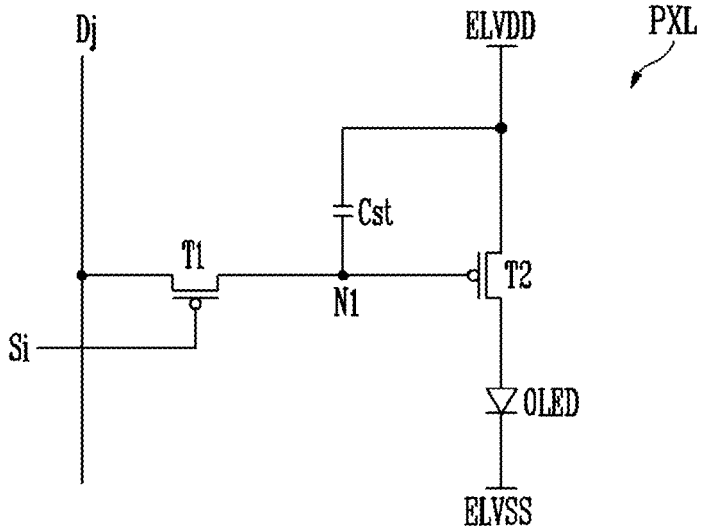
FIG. 2 is a circuit diagram illustrating the structure of a pixel of FIG. 1.

FIG. 2 is a circuit diagram illustrating the structure of the pixel of FIG. 1. For convenience of description, a pixel PXL coupled to an i-th scan line Si and a j-th data line Dj is illustrated in FIG. 2.

Referring to FIG. 2, the pixel PXL may include a first transistor T1, a second transistor T2, a storage capacitor Cst, and an organic light-emitting diode OLED.

The first transistor T1 may include a first electrode coupled to the j-th data line Dj, a gate electrode coupled to the i-th scan line Si, and a second electrode coupled to a first node N1.

When a scan signal is supplied from the i-th scan line Si, the first transistor T1 may be turned on, and may then supply a data signal received from the j-th data line Dj to the storage capacitor Cst.

Here, the storage capacitor Cst may charge a voltage corresponding to the data signal.

The second transistor T2 may include a first electrode coupled to the first power source ELVDD, a second electrode coupled to the OLED, and a gate electrode coupled to the first node N1.

The second transistor T2 may control the amount of current flowing from the first power source ELVDD to the second power source ELVSS via the OLED in correspondence with the value of a voltage stored in the storage capacitor Cst.

The organic light-emitting diode OLED may include a first electrode (i.e., anode electrode) coupled to the second electrode of the second transistor T2 and a second electrode (i.e., cathode electrode) coupled to the second power source ELVSS.

Here, the OLED may generate light corresponding to the amount of current supplied from the second transistor T2.

The OLED may include an organic material which uniquely emits light of any one color, or one or more colors, among three primary colors such as red, green and blue, and the display device 1 may display a desired image through the spatial sum of these colors.

Here, the first electrode of each of the transistors T1 and T2 may be set to any one of a source electrode and a drain electrode, and the second electrode of each of the transistors T1 and T2 may be set to an electrode different from the first electrode. In an exemplary embodiment, when the first electrode is set to a source electrode, the second electrode may be set to a drain electrode, for example.

Also, the transistors T1 and T2 may be p-type metal oxide semiconductor ("PMOS") transistors or n-type metal oxide semiconductor ("NMOS") transistors.

The structure of the pixel PXL illustrated in FIG. 2 is only an exemplary embodiment of the invention, and thus the pixel PXL of the invention is not limited to the foregoing structure. Actually, the pixel PXL has a circuit structure that is capable of supplying current to the organic light-emitting diode OLED, and any one of various currently well-known structures may be selected as the structure of the pixel PXL.

That is, the pixel PXL may further include an additional transistor and an additional capacitor for compensating for current supplied to the OLED in addition to the first transistor T1 and the second transistor T2 illustrated in FIG. 2.

Figures 3, 4:
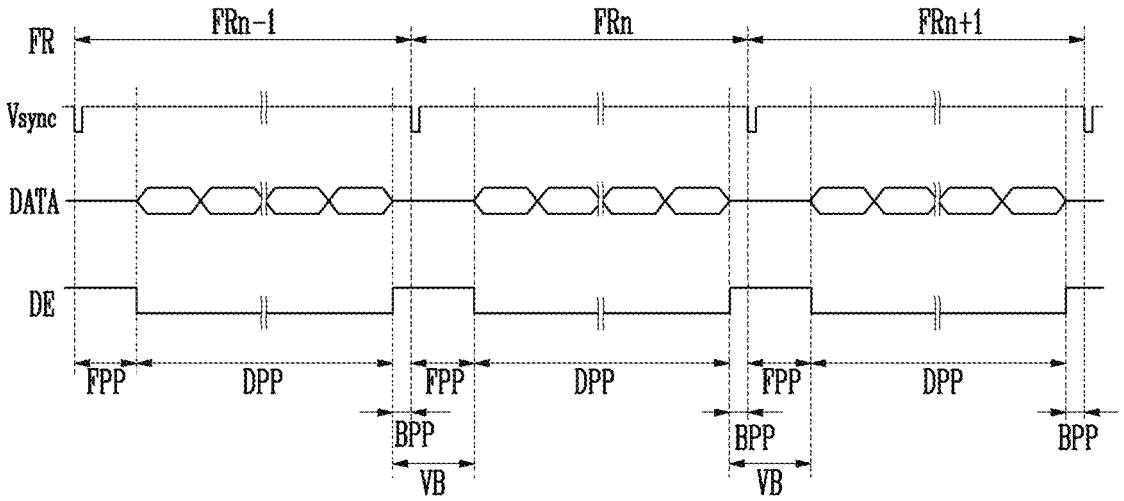
FIG. 3 is a waveform diagram illustrating an exemplary embodiment of a vertical synchronization signal, a data signal, and a data enable signal that are inputted to a display device when the display device is driven in a first mode according to the invention.
FIG. 4 is a diagram illustrating an example in which the lengths of front porch periods, display periods, and back porch periods illustrated in FIG. 3 are exemplarily represented by numerical values.

FIG. 3 is a waveform diagram illustrating a vertical synchronization signal, a data signal, and a data enable signal. In particular, FIG. 3 illustrates a vertical synchronization signal Vsync, a data signal DATA, and a data enable signal DE that are inputted to the timing controller 250 when the display device is driven in a first mode according to the exemplary embodiment of the invention.

Referring to FIG. 3, each frame period FR may include a display period DPP during which an image is displayed on the display unit 100 and a blank period VB during which no image is displayed on the display unit 100.

Respective blank periods VB may be interposed between the display periods DPP. Each blank period VB may include a front porch period FPP and a back porch period BPP.

The front porch period FPP may be an interval between a time point at which the frame period FR starts and a time point at which the display period DPP starts. The back porch period BPP may be an interval between a time point at which the display period DPP ends and a time point at which the frame period FR ends.

The vertical synchronization signal Vsync may define the frame period FR. The vertical synchronization signal Vsync may include a high-level period and a low-level period, and the cycle of the vertical synchronization signal Vsync may correspond to that of the frame period FR. Also, a time point at which the low-level period of the vertical synchronization signal Vsync starts may correspond to the time point at which the frame period FR starts.

The data enable signal DE may define a blank period VB and a display period DPP provided in each of the frame periods FR. In an exemplary embodiment, the data enable signal DE may have a low level in the display period DPP, and may have a high level in the blank period VB, for example.

While the data enable signal DE is maintained at the low level, the data driver 220 may output the data signal.

The display device 1 according to the exemplary embodiment of the invention may be driven in the first mode in which front porch periods FPP, back porch periods BPP, and display periods DPP, included in respective frame periods FR, are maintained at the same lengths without change, or in a second mode in which one or more of the front porch periods FPP, the back porch periods BPP, and the display periods DPP, included in respective frame periods FR, have changed lengths.

FIG. 4 is a diagram illustrating an example in which the lengths of the front porch periods, display periods, and back porch periods illustrated in FIG. 3 are exemplarily represented by numerical values.

Referring to FIGS. 3 and 4, each frame period FR may include a front porch period FPP, a display period DPP, and a back porch period BPP. Assuming that the length of each frame period FR is 2216, the length of the front porch period FPP may be 200, the length of the display period DPP may be 2000, and the length of the back porch period BPP may be 16. That is, the length of the display period DPP, which is the period during which an image is displayed within one frame period FR may be 2000, and the length of the blank period VB during which no image is displayed may be 216.

As illustrated in FIGS. 3 and 4, the lengths of respective frame periods FR may generally be equal to each other. However, according to circumstances, the frame period FR may be changed. In an exemplary embodiment, when a game is executed on a high-resolution display device and an unpredictable image should be displayed, the back porch period BPP may be lengthened so as to sufficiently secure the time desired to process the data signal, for example. That is, the display device 1 may be driven in the second mode.

Figures 5, 6:
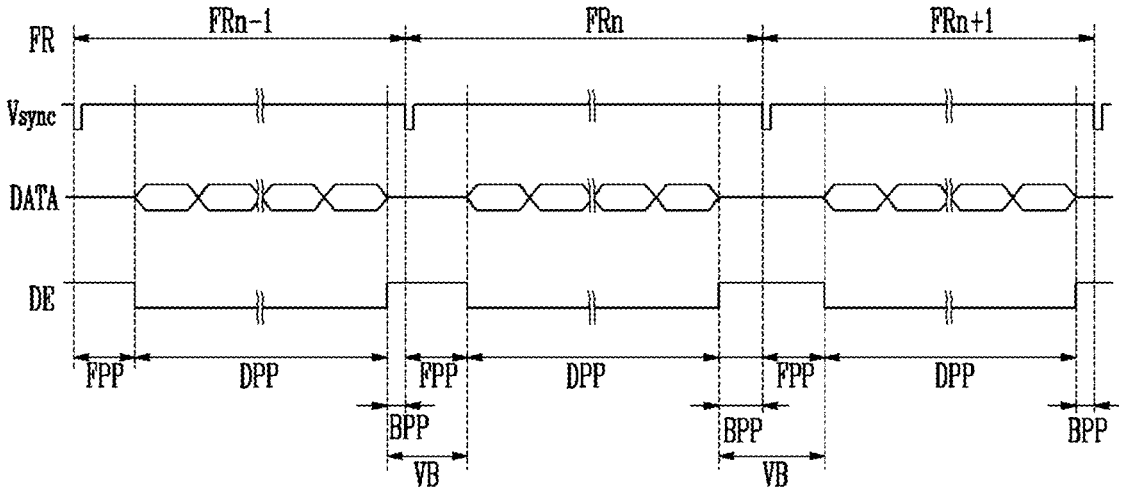
FIG. 5 (PRIOR ART)
FIG. 6 (PRIOR ART)
FIG. 5 is a waveform diagram illustrating conventional technology of a vertical synchronization signal, a data signal, and a data enable signal.
FIG. 6 is a diagram illustrating an example in which the lengths of front porch periods, display periods, and back porch periods illustrated in FIG. 5 are exemplarily represented by numerical values.

FIG. 5 is a waveform diagram illustrating a vertical synchronization signal, a data signal, and a data enable signal according to conventional technology. In particular, FIG. 5 illustrates a vertical synchronization signal Vsync, a data signal DATA, and a data enable signal DE that are inputted to the timing controller 250 when the lengths of respective frame periods FR are different from each other.

Referring to FIG. 5, the lengths of respective frame periods FR may be different from each other. In an exemplary embodiment, the lengths of an n-th frame period FRn and an n+1-th frame period FRn+1 may be greater than that of an n−1-th frame period FRn−1, for example. Here, n is a natural number equal to or greater than 2.

For this, high-level durations of a vertical synchronization signal Vsync defining the n-th frame period FRn and a vertical synchronization signal Vsync defining the n+1-th frame period FRn+1 may be longer than the high-level duration of a vertical synchronization signal Vsync defining the n−1-th frame period FRn−1.

FIG. 6 is a diagram illustrating an example in which the lengths of the front porch periods, display periods, and back porch periods illustrated in FIG. 5 are exemplarily represented by numerical values.

Referring to FIGS. 5 and 6, assuming that the length of the n−1-th frame period FRn−1 is 2216, the length of the n-th frame period FRn may be increased to 2328. Further, the length of the n+1-th frame period FRn+1 is 2258, which may be greater than the length of the n−1-th frame period FRn−1, and may be less than the length of the n-th frame period FRn.

Here, the lengths of respective frame periods FR may be different from each other, but the lengths of the front porch periods FPP may be equal to each other and the lengths of the display periods DPP may be equal to each other in the respective frame periods, but the lengths of the back porch periods BPP may be different from each other.

That is, a blank period VB interposed between the display period DPP of the n−1-th frame period FRn−1 and the display period DPP of the n-th frame period FRn may be shorter than a blank period VB interposed between the display period DPP of the n-th frame period FRn and the display period DPP of the n+1-th frame period FRn+1.

In conventional technology described with reference to FIGS. 5 and 6, in respective frame periods, only the back porch period BPP itself is lengthened while the display period DPP and the front porch period FPP are maintained at the same lengths, and thus the frame period FR itself is lengthened. In this case, whenever the frame is changed, the length of a period during which no image is displayed (i.e., a blank period VB) is changed, and thus the luminance of images may be varied.

Figure 7:
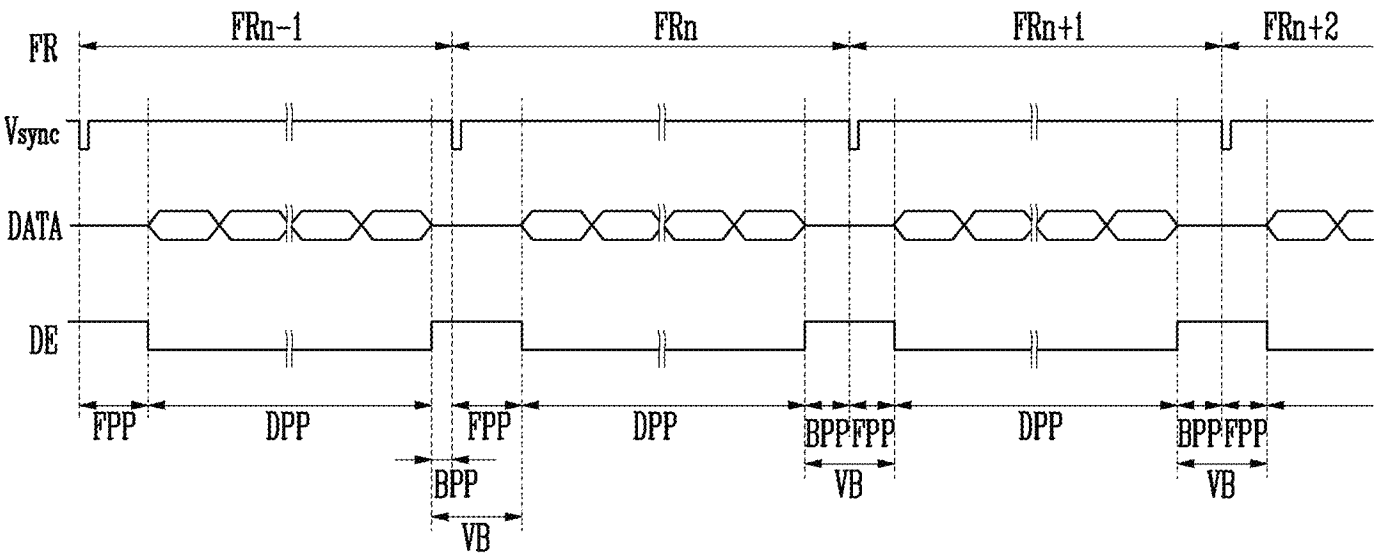
FIG. 7 is a waveform diagram illustrating an exemplary embodiment of a vertical synchronization signal, a data signal, and a data enable signal that are inputted to a display device when the display device is driven in a second mode according to the invention.

FIG. 7 is a waveform diagram illustrating a vertical synchronization signal, a data signal, and a data enable signal. In particular, FIG. 7 illustrates a vertical synchronization signal Vsync, a data signal DATA, and a data enable signal DE that are inputted to the timing controller 250 when the display device is driven in a second mode according to an exemplary embodiment of the invention.

Referring to FIG. 7, the lengths of respective frame periods FR may be different from each other. In an exemplary embodiment, the lengths of an n-th frame period FRn and an n−1-th frame period FRn−1 may be greater than that of an n+1-th frame period FRn+1, for example.

For this, high-level durations of a vertical synchronization signal Vsync defining the n−1-th frame period FRn−1, a vertical synchronization signal Vsync defining the n-th frame period FRn, and a vertical synchronization signal Vsync defining the n+1-th frame period FRn+1 may be different from each other.

FIG. 8 is a diagram illustrating an example in which the lengths of the front porch periods, display periods, and back porch periods illustrated in FIG. 7 are exemplarily represented by numerical values.

Referring to FIGS. 7 and 8, assuming that the length of the n−1-th frame period FRn−1 is 2216, the length of the n-th frame period FRn may be increased to 2328. Further, the length of the n+1-th frame period FRn+1 is 2146, which may be less than the length of the n−1-th frame period FRn−1, and may also be less than the length of the n-th frame period FRn.

Here, only the display periods DPP may be maintained at the same length, and the lengths of the front porch periods FPP and the back porch periods BPP may be changed.

In detail, when the length of a certain back porch period BPP is changed, the length of a front porch period FPP subsequent to the changed back porch period BPP may also be changed depending on the extent to which the length of the back porch period BPP is changed.

That is, the total length of the back porch period BPP and the front porch period FPP that successively appear may be maintained at the same value.

In an exemplary embodiment, as illustrated in FIGS. 7 and 8, when a back porch period BPP having a length of 16 in the n−1-th frame period FRn−1 is changed to have a length of 128 in the n-th frame period FRn, a front porch period FPP having a length of 200 in the n-th frame period FRn may be changed to have a length of 88 in the n+1-th frame period FRn+1, for example.

Further, when the back porch period BPP having a length of 128 in the n-th frame period FRn is changed to have a length of 58 in the n+1-th frame period FRn+1, the front porch period FPP having a length of 88 in the n+1-th frame period FRn+1 may be changed to have a length of 158 in an n+2-th frame period FRn+2.

That is, even when the length of the back porch period BPP is changed whenever the frame is changed, the total length of the back porch period BPP and the front porch period FPP that successively appear may be uniformly maintained at 216.

In this case, a blank period VB interposed between the display period DPP of the n−1-th frame period FRn−1 and the display period DPP of the n-th frame period FRn, a blank period VB interposed between the display period DPP of the n-th frame period FRn and the display period DPP of the n+1-th frame period FRn+1, and a blank period VB interposed between the display period DPP of the n+1-th frame period FRn+1 and the display period DPP of the n+2-th frame period FRn+2 may have the same length.

In other words, even when the vertical synchronization signal Vsync defining each frame period FR is supplied in irregular cycles, the lengths of a period during which an image is displayed (i.e., a display period DPP) and a period during which no image is displayed (i.e., a blank period VB) may not be changed. Therefore, the luminance of images may be uniformly expressed.

The lengths of the back porch period BPP and the front porch period FPP may be changed by adjusting the timing of supply of at least one of the vertical synchronization signal Vsync and the data enable signal DE. The timing at which the vertical synchronization signal Vsync and the data enable signal DE are supplied may be externally set.

In accordance with the invention, there may be provided a display device that is capable of improving display quality.

In accordance with the invention, the length of a back porch period or a front porch period is changed for precise image processing, but blank periods during which no image is displayed are controlled to be maintained at the same length, thus enabling images having uniform luminance to be displayed.

Those skilled in the art to which the invention pertains will understand that the invention may be practiced in other detailed forms without departing from the technical spirit or essential features thereof. Therefore, the above-described embodiments should be regarded as illustrative in all exemplary embodiments rather than restrictive. The scope of the invention should be defined by the accompanying claims rather than the foregoing detailed descriptions, and various modifications, additions and substitutions, which may be derived from the meaning, scope and equivalent concepts of the accompanying claims, should be construed as falling within the scope of the invention.

What is claimed is:

1. A display device, comprising:

a display unit which includes a plurality of pixels and displays an image;

a data driver which supplies a data signal to the plurality of pixels; and a timing controller which controls the data driver using a timing control signal which is externally inputted, wherein the timing control signal comprises a vertical synchronization signal for defining a frame period and a data enable signal for defining a display period during which the image is displayed on the display unit and a blank period during which the image is not displayed on the display unit, and wherein lengths of blank periods are equal to each other in a first driving mode in which the vertical synchronization signal is supplied to the timing controller in a constant cycle and in a second driving mode in which the vertical synchronization signal is supplied to the timing controller in cycles different from the constant cycle, wherein the blank period comprises:

a first porch period between a time point at which the frame period starts and a time point at which the display period starts;

a second porch period between a time point at which the display period ends and a time point at which the frame period ends, and when a length of a second porch period included in an n-th frame period, where n is a natural number equal to or greater than 2, is different from a length of a second porch period included in an n−1-th frame period, a length of a first porch period included in an n+1-th frame period is changed with respect to a length of a first porch period included in the n-th frame period.

2. The display device according to claim 1, wherein a cycle of the vertical synchronization signal is changed as the length of the second porch period is changed.

3. The display device according to claim 1, wherein, in the second driving mode, when the length of the second porch period included in the n-th frame period is increased above the length of the second porch period included in the n−1-th frame period, the length of the first porch period included in the n+1-th frame period is decreased below a length of a first porch period included in the n-th frame period.

4. The display device according to claim 3, wherein an increased length of the second porch period is equal to a decreased length of the first porch period.

5. The display device according to claim 1, wherein, in the second driving mode, when the length of the second porch period included in the n-th frame period is decreased below the length of the second porch period included in the n−1-th frame period, the length of the first porch period included in the n+1-th frame period is increased above a length of a first porch period included in the n-th frame period.

6. The display device according to claim 5, wherein a decreased length of the second porch period is equal to an increased length of the first porch period.

7. The display device according to claim 1, wherein lengths of display periods are equal to each other in the first driving mode and the second driving mode.

8. The display device according to claim 1, wherein the data driver supplies the data signal to the plurality of pixels while the data enable signal is being supplied.

9. The display device according to claim 1, wherein, in the first driving mode, lengths of first porch periods included in respective frame periods are equal to each other and lengths of second porch periods included in the respective frame periods are equal to each other.

10. A method of driving a display device, comprising:

receiving, by a timing controller, a timing control signal which is externally inputted;

controlling, by the timing controller, a data driver in response to the timing control signal; and supplying, by the data driver, a data signal to a plurality of pixels included in a display unit, wherein the timing control signal comprises a vertical synchronization signal for defining a frame period and a data enable signal for defining a display period during which an image is displayed on the display unit and a blank period during which the image is not displayed on the display unit, and wherein lengths of blank periods are equal to each other in a first driving mode in which the vertical synchronization signal is supplied to the timing controller in a constant cycle and in a second driving mode in which the vertical synchronization signal is supplied to the timing controller in cycles different from the constant cycle, wherein the blank period comprises:

a first porch period between a time point at which the frame period starts and a time point at which the display period starts; and a second porch period between a time point at which the display period ends and a time point at which the frame period ends, and when a length of a second porch period included in an n-th frame, where n is a natural number equal to or greater than 2, is different from a length of a second porch period included in an n−1-th frame period, a length of a first porch period included in an n+1-th frame period is changed.

11. The method according to claim 10, wherein, in the second driving mode, when the length of the second porch period included in the n-th frame period is increased above the length of the second porch period included in the n−1-th frame period, the length of the first porch period included in the n+1-th frame period is decreased below a length of a first porch period included in the n-th frame period.

12. The method according to claim 11, wherein an increased length of the second porch period is equal to a decreased length of the first porch period.

13. The method according to claim 10, wherein lengths of display periods are equal to each other in the first driving mode and the second driving mode.

* * * * *